US009044101B2

(12) United States Patent
Garcia et al.

(10) Patent No.: US 9,044,101 B2
(45) Date of Patent: Jun. 2, 2015

(54) CLIMATE CONTROLLED SLEEPING SPACE

(71) Applicants: Mario Garcia Garcia, Seoul (KR); Leif Douglas Karlen, Seoul (KR)

(72) Inventors: Mario Garcia Garcia, Seoul (KR); Leif Douglas Karlen, Seoul (KR)

( * ) Notice: Subject to any disclaimer, the term of this patent is extended or adjusted under 35 U.S.C. 154(b) by 0 days.

(21) Appl. No.: 13/799,253

(22) Filed: Mar. 13, 2013

(65) Prior Publication Data

US 2013/0254989 A1 Oct. 3, 2013

(30) Foreign Application Priority Data

Mar. 29, 2012 (KR) ..... 10-2012-0032135

(51) Int. Cl.
*A47C 21/04* (2006.01)

(52) U.S. Cl.
CPC ..... *A47C 21/046* (2013.01); *A47C 21/044* (2013.01); *A47C 21/048* (2013.01)

(58) Field of Classification Search
CPC .. A47C 21/048; A47C 21/044; A47C 29/003; A61G 11/00; A61G 10/005
USPC ..... 5/113, 121, 421, 423, 512
See application file for complete search history.

(56) References Cited

U.S. PATENT DOCUMENTS 4,937,903 A 7/1990 Joly et al.
5,511,536 A 4/1996 Bussey, Jr. et al.
7,137,881 B2 * 11/2006 Walling ..... 454/251
7,555,792 B2 * 7/2009 Heaton et al. ..... 5/423
7,887,571 B2 * 2/2011 Cochenour et al. ..... 607/96
2002/0173696 A1 * 11/2002 Kolarovic et al. ..... 600/22
2004/0009746 A1 1/2004 Korman
2005/0085687 A1 * 4/2005 Mackin et al. ..... 600/22
2008/0183029 A1 * 7/2008 Mackin et al. ..... 600/22
2009/0240098 A1 * 9/2009 Ten Eyck et al. ..... 600/22
2009/0276958 A1 * 11/2009 Gururaj ..... 5/421
2010/0005588 A1 * 1/2010 Christopher ..... 5/423
2010/0319627 A1 * 12/2010 Cauchy et al. ..... 119/500
2011/0042471 A1 2/2011 Futaeda et al.
2013/0158339 A1 * 6/2013 Cipriano et al. ..... 600/22

OTHER PUBLICATIONS

International Search Report & Written Opinion, PCT/US2013/030864, Jul. 9, 2013, 10 pages.

* cited by examiner

*Primary Examiner* — Timothy D Collins
*Assistant Examiner* — Richard G Davis
(74) *Attorney, Agent, or Firm* — Fish & Richardson P.C.

(57) ABSTRACT

An apparatus includes a frame forming a sleeping space. The apparatus includes a climate control system connected to the frame, the climate control system having a hot side and a cold side, wherein the cold side is positioned toward the sleeping space. The apparatus includes an insulating canopy supported by the frame. The insulating canopy includes an outer layer, a separator layer, a reflective layer, and an inner layer. The separator layer provides an air cavity that reduces conductive heat transfer between the surface layer and the reflective layer.

14 Claims, 8 Drawing Sheets

PERCENT DISSATISFIED

- 0-10
- 10-20
- 20-30
- 30-40
- 40-50
- 50-60
- 60-70
- 70-80
- 80-90
- 90-100

This chart gives the percentage of people dissatisfied (PPD) over a range of indoor air temperature and humidity levels. The calculations are based on the metabolic rate, clothing level, air velocity, and radiant temperature difference given above.

This chart gives the percentage of people dissatisfied (PPD) over a range of indoor air temperature and humidity levels. The calculations are based on the metabolic rate, clothing level, air velocity, and radiant temperature difference given above.

CLIMATE CONTROLLED SLEEPING SPACE

CROSS-REFERENCE TO RELATED APPLICATIONS

This application claims priority to, Korean Patent Registration number 10-2012-0032135 entitled CLIMATE CONTROLLED SLEEPING SPACE, which was filed on Mar. 29, 2012. The disclosure of the foregoing application is incorporated herein by reference in its entirety.

BACKGROUND

Air conditioning is the process of altering the properties of air (primarily temperature and humidity) to more favorable conditions. More generally, air conditioning can refer to any form of technological cooling, heating, ventilation, or disinfection that modifies the condition of air.

SUMMARY

This specification describes technologies relating to climate control.

In some aspects, an apparatus includes a frame forming a sleeping space, a climate control system connected to the frame, and an insulating canopy supported by the frame.

In some additional aspects, an apparatus can include a frame forming a sleeping space, an insulating canopy supported by the frame. The insulating canopy can include an outer layer, a reflective layer, and a separator layer between the outer layer and the reflective layer, the separator layer being configured to provide an air cavity that reduces conductive heat transfer between the outer layer and the reflective layer.

In some additional aspects, an apparatus can include a frame forming a sleeping space, a climate control system connected to the frame, the climate control system including a thermoelectric device having a hot side and a cold side, wherein the cold side is positioned toward the sleeping space, and an insulating canopy supported by the frame.

Embodiments can include one or more of the following.

The climate control system can have a hot side and a cold side with the cold side is positioned toward the sleeping space.

The insulating canopy can include an outer layer, a reflective layer, and a separator layer between the outer layer and the reflective layer, the separator layer being configured to provide an air cavity that reduces conductive heat transfer between the outer layer and the reflective layer.

The apparatus can also include physiological sensors including at least one of the group consisting of an infra-red thermometer, a three dimensional scanner, and a proximity sensor.

The physiological sensors can be configured to provide sensor readings to a data processing unit.

The data processing unit can be configured to provide control signals to the climate control system based, at least in part, on the sensor readings.

The physiological sensors can include the proximity sensor and the proximity sensor is configured to determine the presence and position of an individual within the sleeping space.

The physiological sensors can include the infra-red thermometer and the infra-red thermometer is configured to measure the temperature of the skin of an individual within the sleeping space.

The physiological sensors can include the three dimensional scanner, and the three dimensional scanner is configured to measures changes to the thoracic cavity of an individual within the sleeping space.

The reflective layer can be aluminized BoPET.

The insulating canopy can include an outer layer, a reflective layer, and a separator layer between the outer layer and the reflective layer, the separator layer being configured to provide an air cavity that reduces conductive heat transfer between the outer layer and the reflective layer.

Particular embodiments of the subject matter described in this specification can be implemented so as to realize one or more of the following advantages. The climate controlled sleeping space may reduce the amount of energy required for the occupant to sleep comfortably. The overall volume of atmosphere that must be managed may be smaller relative than other forms of residential climate control.

The details of one or more embodiments of the subject matter described in this specification are set forth in the accompanying drawings and the description below. Other features, aspects, and advantages of the subject matter will become apparent from the description, the drawings, and the claims.

DETAILED DESCRIPTION

Figure 1:
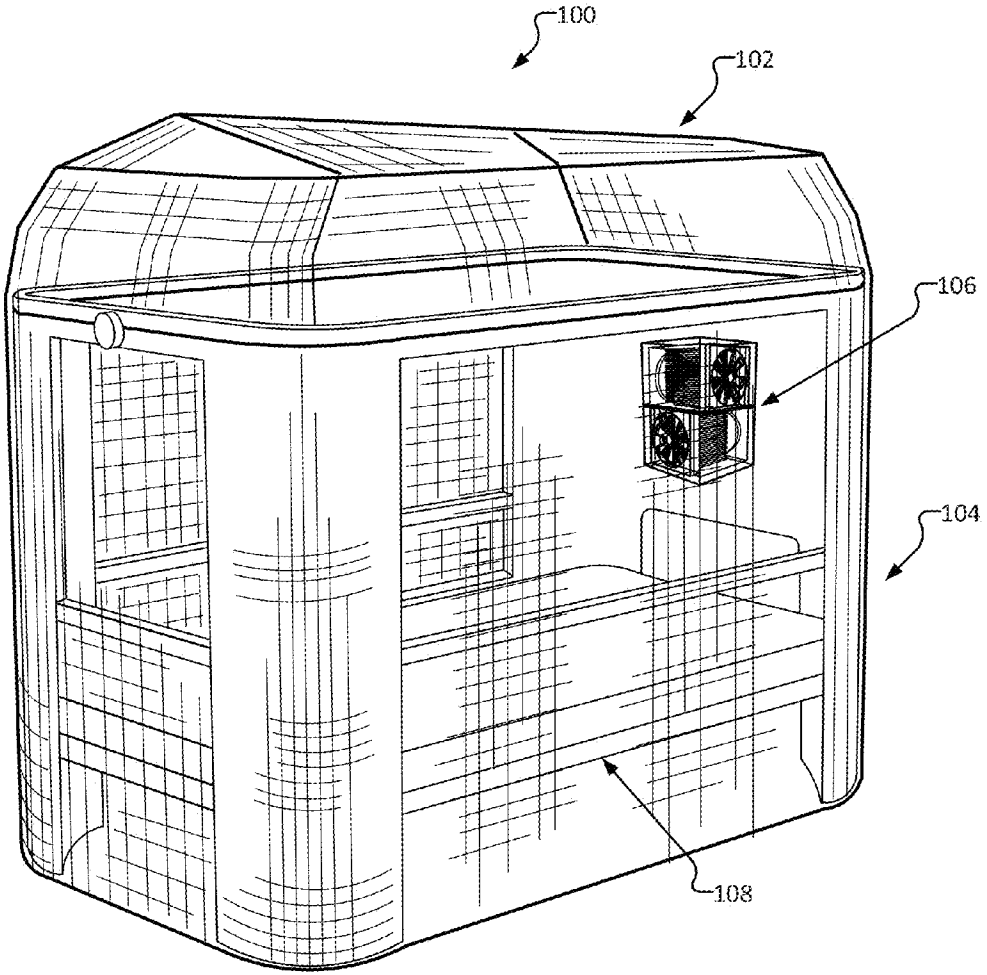
FIG. 1 is an illustration of an exemplary climate controlled sleeping space.

A climate-controlled sleeping space as described herein can control radiative, conductive, convective and evaporative heat flux in order to provide the occupant or occupants with a hospitable environment so that the occupant's biological thermoregulation may function properly. Additionally, by enclosing the climate controlled environment in a space restricted canopy, the overall volume of atmosphere that must be managed is smaller relative than other forms of residential climate control such as whole room or residence climate control. The climate controlled sleeping space will therefore greatly reduce the amount of energy required for the occupant to sleep comfortably as compared to other forms of climate control such as whole residence or room climate control.

Currently, some residential climate control solutions have three problems. First, thermostats attempt to control the climate by measuring only sensitive heat, ignoring the importance of water vapor saturation and thermal radiation. Second, current air-conditioning units do not provide locality, which means that you either cool or heat a residence or room in its entirety or not at all. Third, temperature measurements are provided by a single thermostat in the residence, the reading of which does not accurately reflect the temperature of other areas in that same residence.

The rate at which the human body gains or loses heat (S) depends on metabolic heat production (M), Mechanical Work (W), radiation exchanges with surroundings (R), Convection Exchanges with air layers (C), Conduction to or from clothing (K), evaporation losses in sweating (E), and wet and dry heat exchanges (Res). The S, also known as the "heat load," can be calculated by the following equation.

$$S=M-W\pm R\pm C\pm K-E\pm \mathrm{Res}$$

The third term, R, can be affected by a thermal radiation shield that decreases the amount of thermal radiation reaching the individual from his/her surroundings. In general, a thermal radiation shield can be any device or material designed to reflect thermal radiation and prohibit thermal radiation from passing through the device or material. The thermal radiation shield would then allow for a substantial decrease in the thermal load. When a human body is at rest, it produces approximately 100 W of heat through regular metabolic activity. The above formula indicates that in order to dispose of this heat properly, without engaging in excessive perspiration, the amount of radiation absorbed from the environment should correspond to a temperature of approximately 20-25 degrees Celsius. It is for this reason that comfortable room temperature remains is in the range of that figure. As the ambient temperature begins to rise, more thermal radiation is absorbed by the individual, and then this must be offset with additional cooling provided by evaporation through perspiration. Perspiration can efficiently dispose of the excess heat in these circumstances where there is a larger inflow of thermal radiation from the environment, but perspiration can also cause discomfort to the individual.

The increase and decrease due to thermal radiation can be approximated with the following equation $$\text{Rate of heating or cooling of a body} = \frac{\Delta Q}{\Delta t} = e\sigma A(T_1^4 - T_2^4)$$

where e is the emissivity of the object, σ is the Stefan-Boltzmann constant, A is the area of the surface exposed to the environment, $T_1$ is the temperature of the skin of the individual, and $T_2$ is the mean radiant temperature of the environment. (Note: the mean radiant temperature does not always coincide with the air temperature of the environment.)

As temperature and humidity increase, the mean radiant temperature can cause a positive inflow of thermal radiation into the human body, while the saturation of water vapor in the atmosphere will inhibit the evaporation of perspiration. Therefore, biological thermoregulation becomes insufficient in order to provide comfort to the individual. In such a circumstance, additional cooling becomes necessary to provide comfort.

Conventional residential air-conditioning units operate by condensing water molecules away from hot and humid air. That method is highly inefficient since those units do not provide a manner contain the cool, dry air only in the area the occupant inhabits. While it may be difficult to track an individual throughout their daily routines, the same is not true at night. While an individual sleeps, he or she only occupies the space directly above the bed, and the person does not move from there for a period of six to eight hours. Therefore, the vast majority of the air is wasted cooling areas that are not under use while the individual sleeps.

Additionally, air conditioning only reduces the temperature of the air, but does not reduce the temperature of solid surfaces within the residence. For this reason, those surfaces still emit thermal radiation. Therefore, the air conditioner must cool the air to the point where an individual can release the metabolic heat in addition to the heat gained from thermal radiation from the environment.

The climate-controlled sleeping space can mitigate these three problems. For example, a climate controlled sleeping space may utilize materials that can insulate the sleeping chamber from thermal radiation, contain the cool, comfortable air in a relatively small space, and/or measure a full range of climactic conditions in close proximity to the occupant and adjust a climate control system accordingly.

Referring to FIG. 1, in some arrangements, a sleeping space 100 is composed of an insulating canopy 102, a frame 104 for structural rigidity, and a climate control system 106 with an electronic control unit. The sleeping space includes a sleeping platform 108 adjacent to the frame or supported by the frame 104. In general, the frame 104 can include multiple vertically extending pillars or support structures that form an enclosed space around the sleeping platform 108. Additionally, the top portions of the vertically extending pillars can be joined by solid connection rods or portions that provide a place to secure the canopy 102 and ensure that the pillars will not bend or bow causing the canopy to contact the individual within the sleeping space. Thus, the canopy 102 can extend around the vertically extending pillars and across a top opening between the pillars to form an enclosed space. In general, the height of the pillars of the support structure can be determined based on the intended use and comfort of individuals who are likely to be sleeping on the sleeping platform 108. For example, for sleeping platforms such as cribs or child beds, the pillars may be shorter than for adults. Exemplary volumes enclosed by the canopy can range from 39 cubic feet to 220 cubic feet. In further examples, a child's crib or bed can have a volume of from about 30 cubic feet to 50 cubic feet, a sleeping space designed for a single individual (e.g., having a sleeping platform of a twin or single bed size) can have a volume of from about 80 cubic feet to 120 cubic feet, and a sleeping space designed for multiple individuals (e.g., having a sleeping platform accommodating a double, queen or king size mattress) can have a volume of from about 140 cubic feet to 220 cubic feet.

Figure 7:
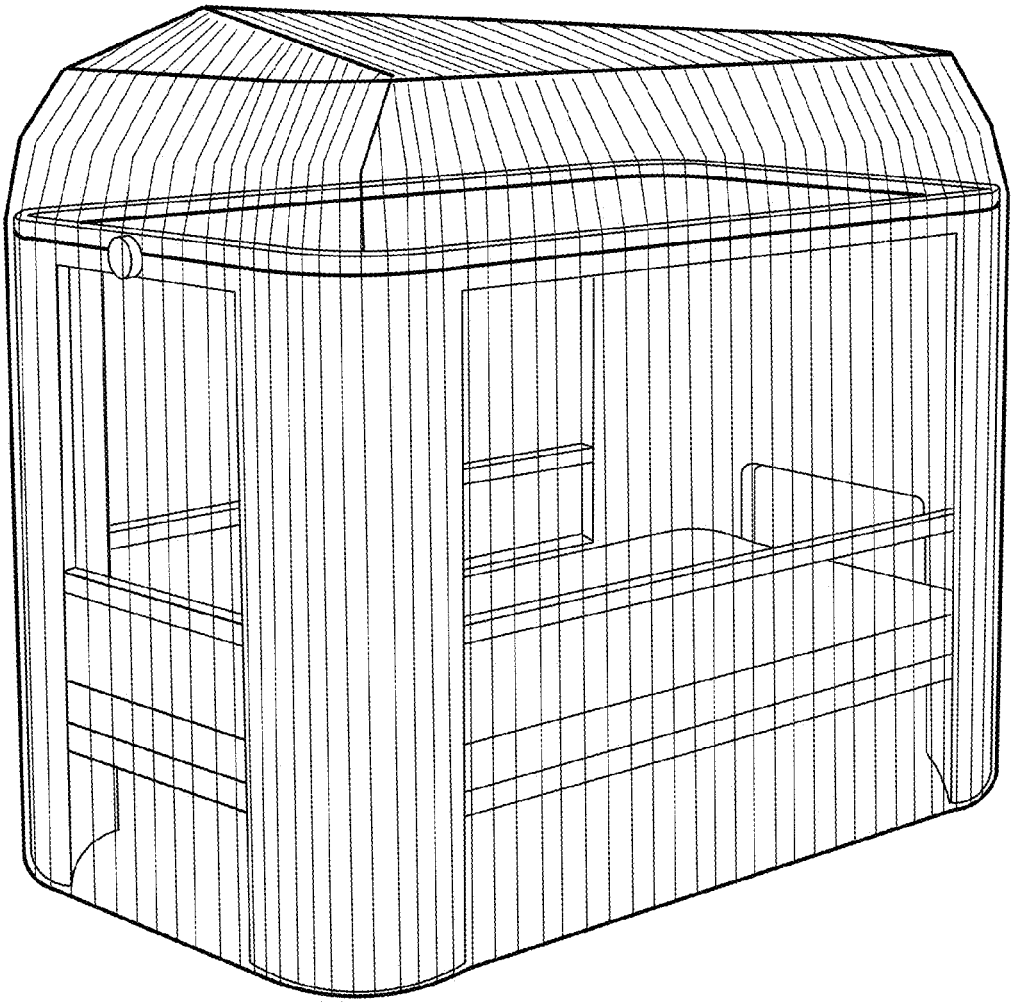
FIG. 7 is an illustration of an exemplary climate controlled sleeping space.

In some examples, the frame can include one or more semi-solid walls that include an opening or window to allow visibility. The opening or window in the semi-solid wall(s) can be covered by a portion of the canopy (e.g., as shown in FIG. 7).

The frame 104 can also include a mechanism to enter and exit the sleeping space. For example, as shown in FIG. 1, the frame can include a hinged top portion that can be raised or lowered to allow an individual to place a child within the enclosed sleeping space. In other examples, the frame could include a door on a side of the sleeping space to allow an individual to enter or exit the sleeping platform from a side of the unit. When the top portion or door is in a closed position, the frame and canopy form an enclosed sleeping space.

In some arrangements, the canopy 102 may be comprised of a textile with the following properties:

1. The canopy can be formed of a material that provides water vapor impermeability in order to be able to maintain a differential in humidity between the sleeping space and the external environment.

2. The canopy can be formed of a material that is permeable to oxygen and carbon dioxide in order to ensure safety of the occupant from asphyxiation.

3. The canopy can be formed of a material that reflects incoming infrared and visible light in order to protect the occupant from incoming thermal radiation.

The thermal insulation provided by the canopy may have the effect of allowing the occupant to feel comfort at higher ambient temperature and humidity levels.

Figure 2:
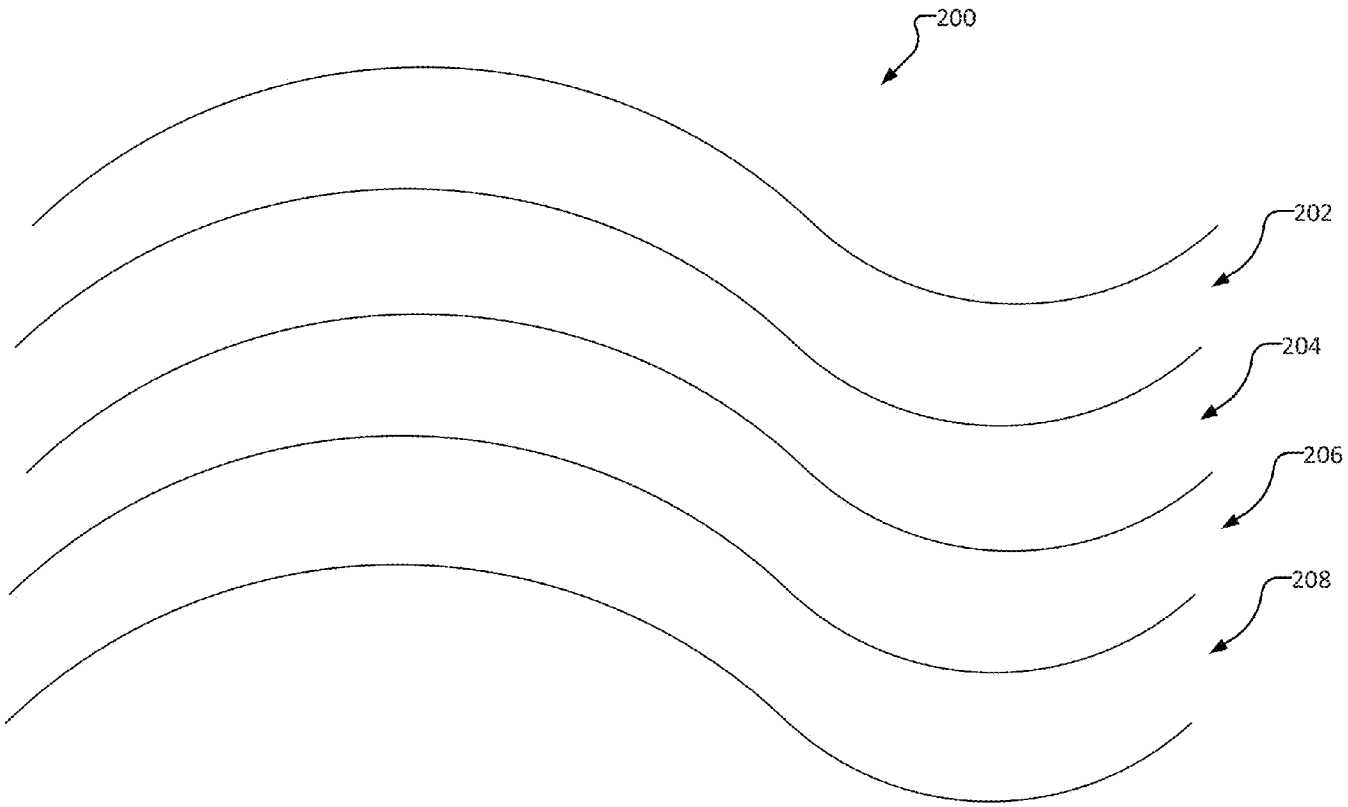
FIG. 2 is an illustration of an example of layers of an insulating canopy.

Referring to FIG. 2, the canopy may be composed of multiple layers 200 that provide the material the insulating properties. The topmost layer may be surface textile 202 that provides the function of dispersing visible light and providing an outer covering to give the climate controlled sleeping space an aesthetically pleasing surface. The outer covering can include a printed pattern to enhance the visual aesthetics. For example, a child's bed could be patterned to look like a tent, pirate ship, race car, or a princess castle or to have another pattern that is pleasing to a child. In other examples, the outer covering could have a color to match a color pallet of a room.

The next layer may be a separator 204 that serves the purpose of providing an air cavity to reduces conductive heat transfer between the surface layer and a third layer 206. In one example, a nylon or polyester layer is used as the separator 204. In some examples, the separator 204 is formed of a material that contains multiple air pockets. The separator may be flexible or rigid, and can be composed of an insulating fabric or foam. These materials may be selectively used in segments of the canopy in order to balance the thermal insulation of the canopy and the inflow of external ambient light. For example, thicker insulation would allow greater thermal control but less ambient light coming in from the sides of the canopy, but thinner insulation will provide less thermal control but would allow more ambient light to enter from the top of the canopy. Thus, in some embodiments only some portions of the canopy would include the separator material 204 while other portions omit the separator material to allow greater ambient light through the canopy. In some additional embodiments some portions of the canopy would include a separator material 204 having a first thickness while other portions have a separator material having a second thickness that is less than the first thickness (e.g., 2× less, 3× less) to allow greater ambient light through the canopy.

The third layer 206 may be a reflective layer that serves the purpose of reflecting incoming radiation. For example, the third layer can be formed of a polyester film made from stretched polyethylene terephthalate (PET) such as, for example, aluminized biaxially-oriented polyethylene terephthalate (BoPET) which reflects incoming thermal radiation back into the environment. Thus, the light that impinges upon the outside of the canopy is reflected and does not pass the thermal radiation into the interior sleeping space. Reflecting incoming radiation shields the occupant of the climate controlled sleeping space from thermal radiation emanating from the environment. In some examples, the layer 206 can reflect at least 50-95% (e.g., 70-80%) of the incoming radiation. In some alternative examples, the layer 206 can reflect a significantly smaller portion of the incoming radiation, e.g., 10-40%.

The last layer will be an inner surface textile 208 that may be made of a material similar to the surface textile. This layer can serve the function of dispersing visible light and providing an inner covering to give the climate controlled sleeping space an aesthetically pleasing inner surface.

In some examples, additional layers could be included in the canopy. For example, the outer and inner surfaces of the canopy can also provide a hypoallergenic and/or antibacterial surface. Additionally, increased thermal management can be achieved by inserting a layer that is permeable to oxygen and carbon dioxide (for safety of the occupant), but impermeable to water vapor to ensure that the water vapor extracted by the cooling unit does not diffuse back in through the canopy.

Figure 3A:
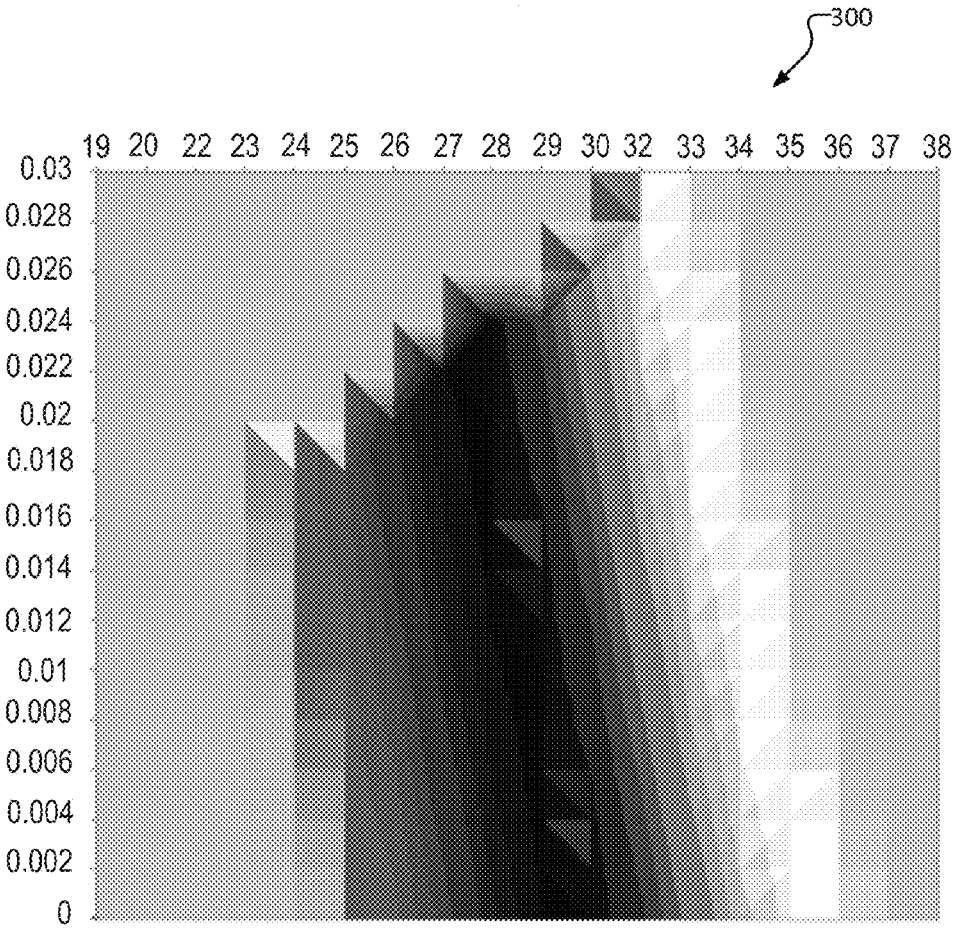
FIGS. 3A-3B are charts that provide exemplary percentages of individuals dissatisfied at various temperatures and humidity levels.
Figure 3B:
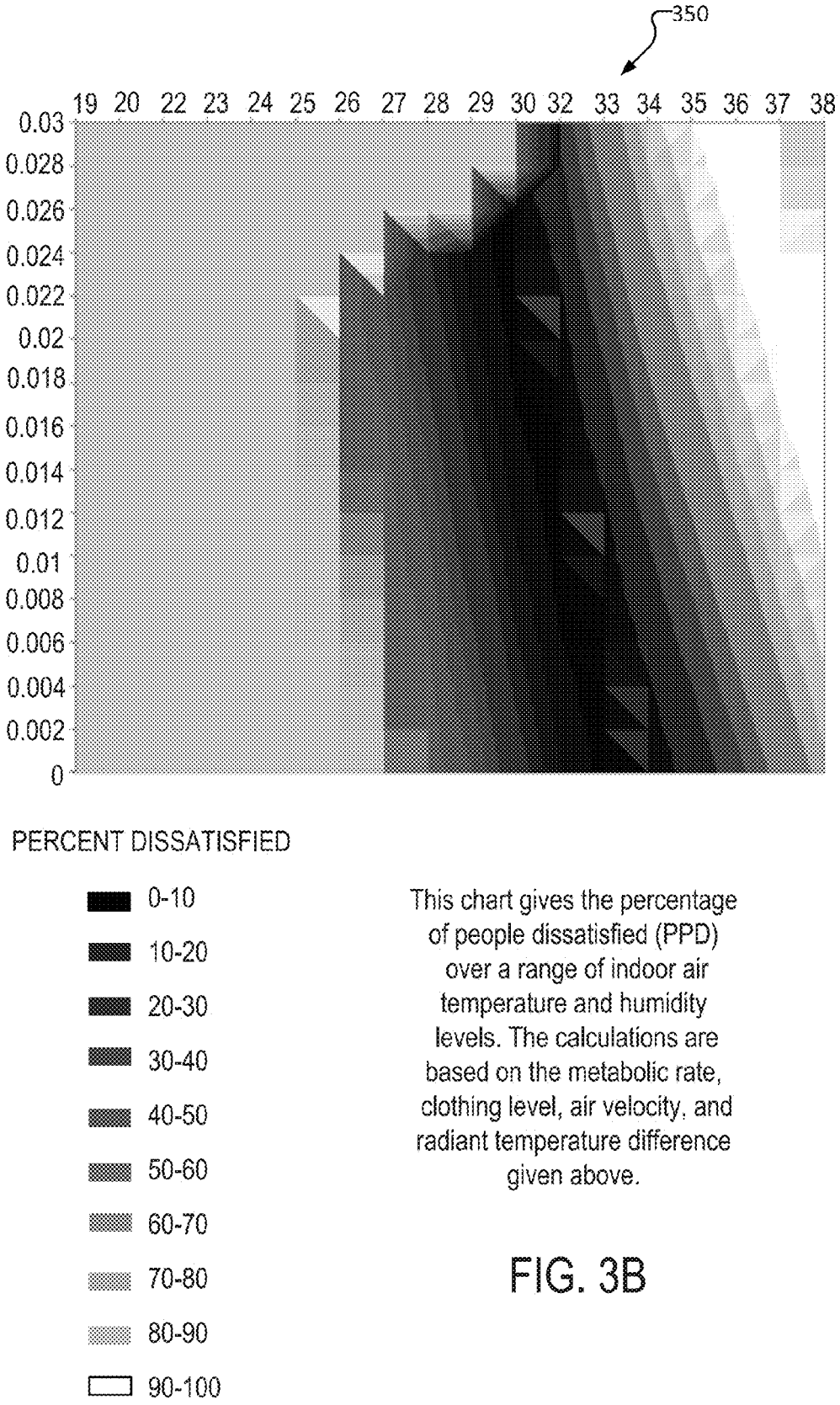

Referring to FIG. 3A-B, The American Society of Heating, Refrigeration, and Air-Conditioning Engineers (ASHRAE) have defined thermal comfort under the ASHRAE Standard 55. This standard considers personal factors (health, psychology, sociology and situational), clothing, activity levels, air temperature, mean radiant temperature, and relative humidity, among others, to establish a range of temperature and humidity levels that cooling and heating systems should accomplish in order to provide the occupants with a comfortable environment for habitation. The net effect of the insulating canopy of the climate-controlled sleeping space will be to shift the comfort curve to the right so that individuals may feel comfortable at higher temperature and humidity levels. Due to such a shift, the need for and power use of a cooling system will be reduced.

FIG. 3A illustrates a percentage of people dissatisfied over a range of indoor temperatures and humidity levels without using the sleeping space. FIG. 3B illustrates a percentage of people dissatisfied over a range of indoor temperatures and humidity levels using the sleeping space. The data illustrates that the net effect of implementing a thermal radiation barrier will shift the range of comfortable temperatures an approximate 5 degrees Celsius in the positive direction. This essentially means that individuals will not report discomfort at these higher temperatures and humidity levels.

Climate Control System

Figure 4:
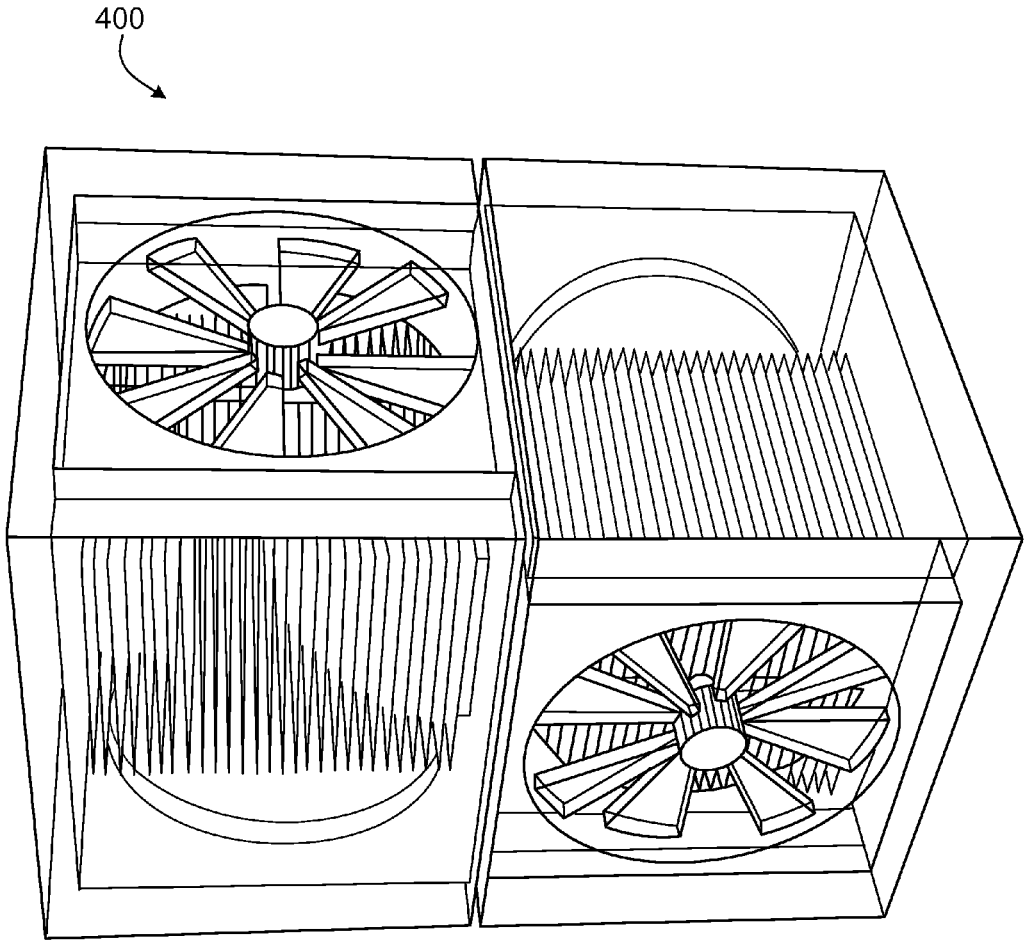
FIG. 4 is an illustration of an exemplary climate control unit.
Figure 5:
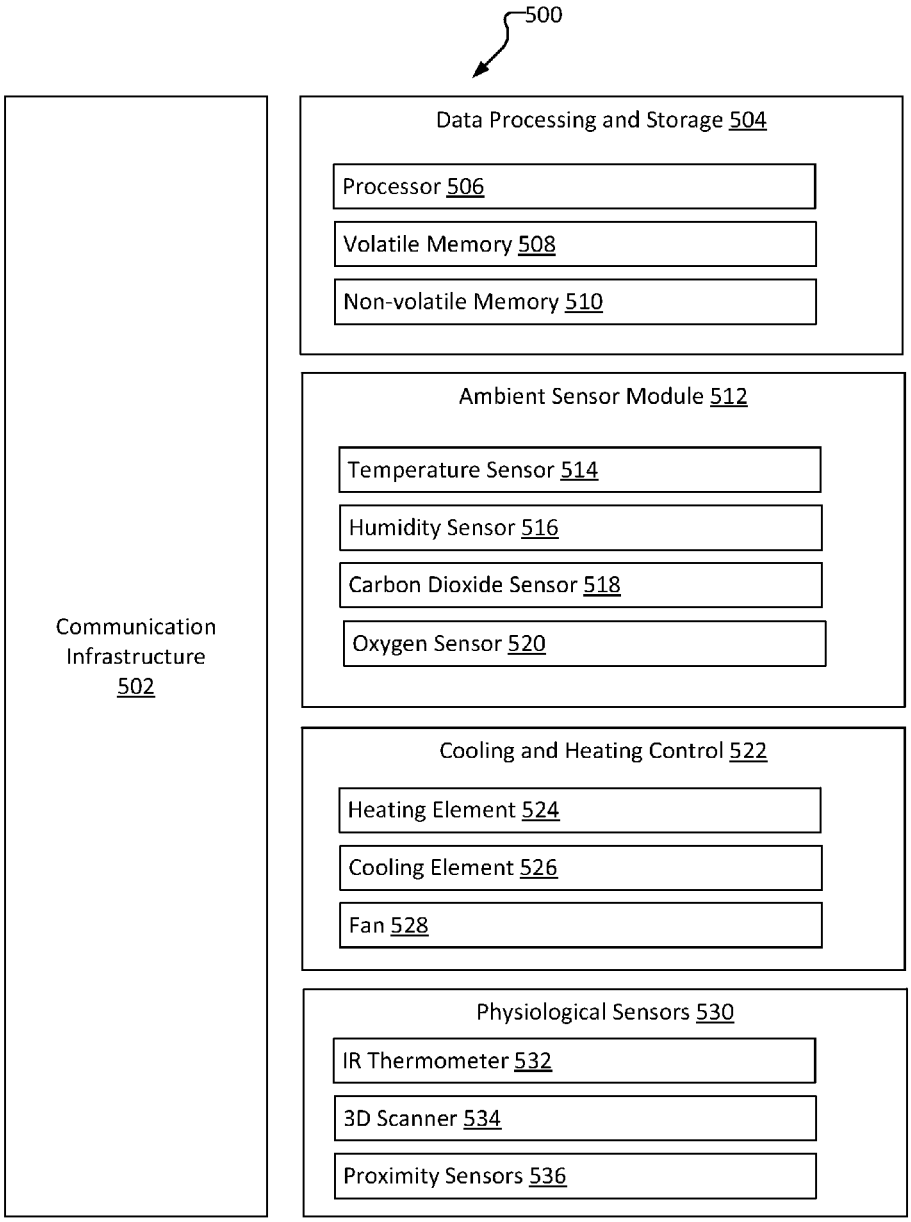
FIG. 5 is an illustration of an electronic control unit.

Referring to FIG. 4, thermoelectric coolers, for example, thermoelectric cooler 400, may further decrease the heat load on the occupant by cooling the space within the canopy 102 to levels lower than those of the external environment. In general, a thermoelectric cooler can be any cooler that operates based on the Peltier effect (also called the thermoelectric effect). In general, a thermoelectric cooling device has two sides, and when DC current flows through the device, heat is transferred from one side to the other causing one side gets cooler while the other gets hotter. The "hot" side can be attached to a heat sink so that it remains at or near ambient temperature, while the cool side goes below room temperature. The thermoelectric cooler 400 will be connected to heat sinks with heat pipes that will increase the surface area of the cooling element, providing more efficient heat transfer through conduction and convection. As noted herein, the thermoelectric cooler has a "hot" side and a "cold" side. Generally, when installed in the climate controlled sleeping space the hot side is oriented towards the outside of the canopy and dissipates heat into the surrounding air, while the cold side chills and dehumidifies the internal air. Both sides (hot and cold) can be isolated from each other using a thermal insulating material.

A cooling unit can also include one or more fans configured to direct airflow into and out of the sleeping space. For example, as shown in the example of FIG. 4, the unit includes two fans. One fan is oriented toward the ceiling and serves to extract the exhaust heat from the heatsink that is attached to the thermoelectric cooler while the other fan is oriented towards the occupant. The use of multiple fans allows the unit to ensure that exhaust heat flow does not mix with intake flow of air.

The cooling unit can be attached to the frame of the sleeping space. The cooling unit may be attached in a position where the cool airflow is in close proximity to the occupant's head so that cool air may remove moisture from the surface of the occupants skin before the air becomes saturated with water vapor from the internal environment.

Electronic Control Unit

The climate control system may utilize a sensor array that monitors the temperature and humidity inside of the canopy in order to automatically control the cooling power and the fan speed on the device to user selected temperature and humidity levels. An electronic control unit 500 may include a Data Processing and Storage Unit 504, one or multiple Ambient Sensor Modules 512, one or multiple Cooling and Heating Control 522 units, and one or multiple Physiological sensor 530 modules. A communication infrastructure 502 can enable communication between the Data Processing and Storage Unit 504, the Ambient Sensor Modules 512, the Cooling and Heating Control 522, and the Physiological Sensors 530.

The Data Processing and Storage Unit 504 may include a processor 506, volatile memory 508, and non-volatile memory 510. The processor can receive input from the one or multiple ambient sensor module 512 and the physiological sensor modules 530. This input can be processed and can result in control signals being sent to the cooling and heating control 522 in order to increase or decrease power to the heating element 524, to the cooling element 526, or to the fan 528. The system can work in an adaptive manner whereby the system engages in heating or cooling in response to radiation exchanges with surroundings and estimated convection with air layers. Both the wet and dry heat exchanges can be measured in order to optimize the cooling or heating power and the fan speed of the system.

An ambient sensor module 512 can include temperature sensors 514, humidity sensors 516, oxygen sensors 520, and carbon dioxide sensors 518. These sensors may be placed internally and/or externally. The temperature and humidity sensors will measure the sensible heat and the latent heat of the air inside and outside of the canopy. This sensory input will allow the cooling unit to increase or decrease the fan speed and cooling power. The oxygen and carbon dioxide sensors can provide information of air quality to the occupant. If there is an increase in carbon dioxide concentration within the sleeping space, the fan speed of the cooling unit may increase to provide additional ventilation. Additionally, an audible or visible alarm may sound to alert the occupant of unsafe carbon dioxide levels.

A physiological sensor module 530 may include an IR Thermometer 532, a 3-D Scanner 534 and/or Proximity Sensors 536. In some arrangements, an Infra-red thermometer 532 of a physiological sensor module 530 can be tasked with measuring the temperature of the inhabitant's skin that is directly exposed to the environment. 3D scanners 534 can measure the circumference and changes thereof of the thoracic cavity in order to approximate the breathing rate and tidal volume of the lungs. Proximity sensors 536 can indicate the presence and position of the inhabitant within the climate controlled sleeping space. In the presence of these sensors, the processor 506 can compute the overall metabolic activity of the occupant to further optimize the cooling and heating of the climate controlled sleeping space.

An individual at rest, but awake, can produce approximately 100 Watts of heat. When the individual falls asleep, metabolic processes drop and the amount of heat produced drops approximately 30%, thereby producing approximately 70 Watts of heat. The climate controlled sleeping unit can respond to this metabolic change through the analysis of any one of the physiological sensors. When an increase or decrease in metabolic heat production is detected, the climate controlled sleeping space will therefore adjust the power output of the heating element, cooling element, and/or fan.

Figure 6:
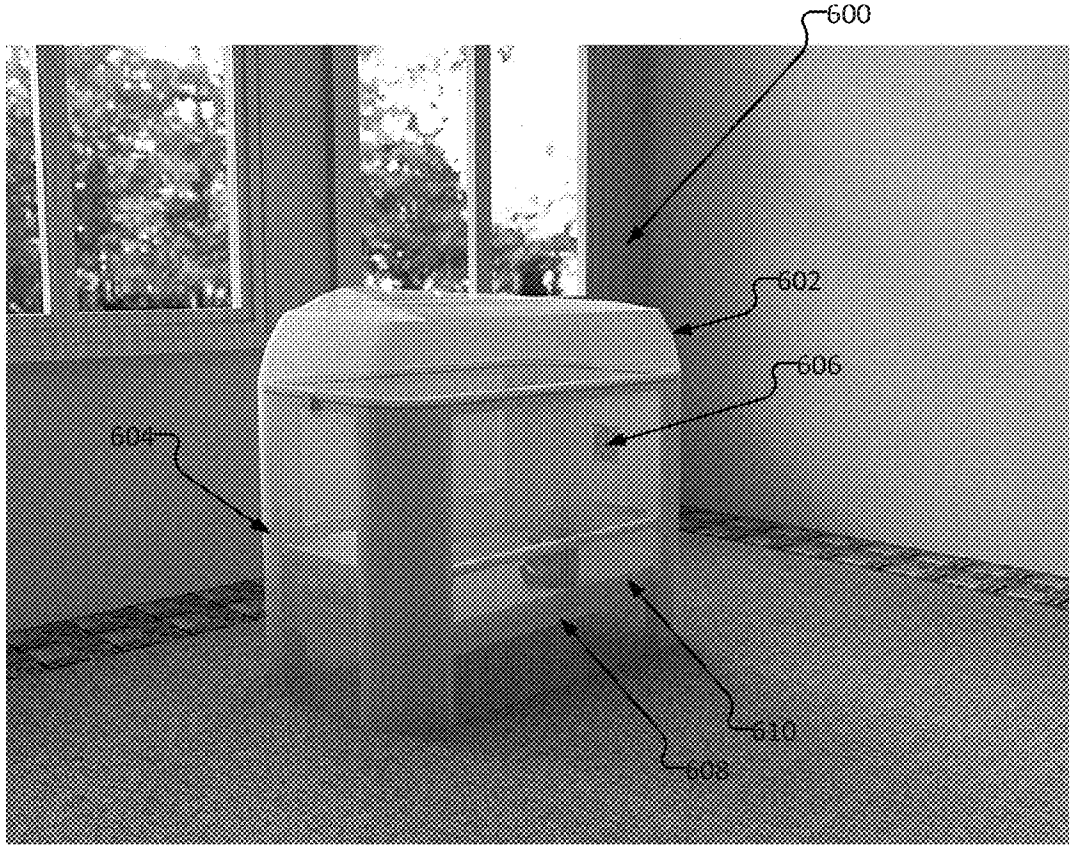
FIG. 6 is an illustration of another exemplary climate controlled sleeping space.

FIG. 6 illustrates another example of a climate controlled sleeping space. In this example, the climate controlled sleeping space 600 is composed of an insulating canopy 602, a frame 604 for structural rigidity, and a climate control system 606 with an electronic control unit. The sleeping space includes a sleeping platform 608 adjacent to the frame. In this example, the sleeping platform 608 includes a bed including a mattress 610 on top of the sleeping platform 608. In some arrangements, the climate controlled sleeping space has a horizontal extent about the size as the sleeping platform.

What is claimed is:

1. An apparatus comprising:

a frame forming a sleeping space;

oxygen and carbon dioxide sensors configured to provide sensor readings to a data processing unit;

a climate control system connected to the frame, the climate control system having a hot side and a cold side, wherein the cold side is positioned toward the sleeping space; and an insulating canopy supported by the frame, the insulating canopy comprising:

an outer layer, a reflective layer; and a separator layer between the outer layer and the reflective layer, the separator layer being configured to provide an air cavity that reduces conductive heat transfer between the outer layer and the reflective layer;

wherein the climate control system comprises a thermoelectric cooler that operates based on the Pelletier effect, a first fan oriented toward the ceiling, and a second fan oriented towards the sleeping space; and wherein the data processing unit is configured to provide control signals to the climate control system to increase a fan speed of the first fan, the second fan, or both based, at least in part, on sensor readings indicating an increase in carbon dioxide concentration within the sleeping space.

2. The apparatus of claim 1, further comprising physiological sensors including at least one of the group consisting of an infra-red thermometer, a three dimensional scanner, and a proximity sensor.

3. The apparatus of claim 2, wherein the physiological sensors include the proximity sensor and the proximity sensor is configured to determine the presence and position of an individual within the sleeping space.

4. The apparatus of claim 3, wherein the physiological sensors include the three dimensional scanner, and the three dimensional scanner is configured to measures changes to the thoracic cavity of an individual within the sleeping space.

5. The apparatus of claim 2, wherein the physiological sensors include the infra-red thermometer and the infra-red thermometer is configured to measure the temperature of the skin of an individual within the sleeping space.

6. The apparatus of claim 1, wherein the reflective layer comprises aluminized BoPET.

7. The apparatus of claim 1, wherein the separator layer comprises a material that contains multiple air pockets.

8. An apparatus comprising:

a frame forming a sleeping space;

oxygen and carbon dioxide sensors configured to provide sensor readings to a data processing unit a climate control system connected to the frame, the climate control system including a thermoelectric device having a hot side and a cold side, wherein the cold side is positioned toward the sleeping space; and an insulating canopy supported by the frame;

wherein the climate control system comprises a thermoelectric cooler that operates based on the Pelletier effect, a first fan oriented toward the ceiling, and a second fan oriented towards the sleeping space; and wherein the data processing unit is configured to provide control signals to the climate control system to increase a fan speed of the first fan, the second fan, or both based, at least in part, on sensor readings indicating an increase in carbon dioxide concentration within the sleeping space.

9. The apparatus of claim 8, further comprising physiological sensors including at least one of the group consisting of an infra-red thermometer, a three dimensional scanner, and a proximity sensor.

10. The apparatus of claim 9, wherein the physiological sensors include the proximity sensor and the proximity sensor is configured to determine the presence and position of an individual within the sleeping space.

11. The apparatus of claim 10, wherein the physiological sensors include the infra-red thermometer and the infra-red thermometer is configured to measure the temperature of the skin of an individual within the sleeping space.

12. The apparatus of claim 11, wherein the physiological sensors include the three dimensional scanner, and the three dimensional scanner is configured to measures changes to the thoracic cavity of an individual within the sleeping space.

13. The apparatus of claim 9, wherein the insulating canopy comprises:

an outer layer, a reflective layer; and a separator layer between the outer layer and the reflective layer, the separator layer being configured to provide an air cavity that reduces conductive heat transfer between the outer layer and the reflective layer.

14. The apparatus of claim 13, wherein the reflective layer comprises aluminized BoPET.

* * * * *

UNITED STATES PATENT AND TRADEMARK OFFICE

CERTIFICATE OF CORRECTION

PATENT NO. : 9,044,101 B2
APPLICATION NO. : 13/799253
DATED : June 2, 2015
INVENTOR(S) : Garcia et al.

It is certified that error appears in the above-identified patent and that said Letters Patent is hereby corrected as shown below:

In the claims

Column 9, line 12, Claim 11, delete "claim 10," and insert -- claim 9, --.

Column 9, line 16, Claim 12, delete "claim 11," and insert -- claim 9, --.

Column 9, line 20, Claim 13, delete "claim 11," and insert -- claim 8, --.

Signed and Sealed this
Third Day of November, 2015

Michelle K. Lee

Michelle K. Lee
*Director of the United States Patent and Trademark Office*